US010804655B2

(12) United States Patent
Demaratos

(10) Patent No.: US 10,804,655 B2
(45) Date of Patent: Oct. 13, 2020

(54) METHOD FOR ELECTROMAGNETIC INTERFERENCE (EMI) PROTECTION FOR A CONNECTOR ASSEMBLY USING A CONDUCTIVE SEAL

(71) Applicant: J.S.T. CORPORATION, Farmington Hills, MI (US)

(72) Inventor: David Demaratos, Wixom, MI (US)

(73) Assignee: J.S.T. CORPORATION, Farmington Hills, MI (US)

( * ) Notice: Subject to any disclaimer, the term of this patent is extended or adjusted under 35 U.S.C. 154(b) by 0 days.

(21) Appl. No.: 16/447,731

(22) Filed: Jun. 20, 2019

(65) Prior Publication Data

US 2020/0280150 A1 Sep. 3, 2020

Related U.S. Application Data

(60) Provisional application No. 62/811,873, filed on Feb. 28, 2019.

(51) Int. Cl.

| | |
|---|---|
| ***H01R 13/6592*** | (2011.01) |
| ***H01R 13/73*** | (2006.01) |
| ***H01R 9/05*** | (2006.01) |
| ***H01R 13/52*** | (2006.01) |

(52) U.S. Cl.

CPC ..... *H01R 13/6592* (2013.01); *H01R 9/0518* (2013.01); *H01R 13/5221* (2013.01); *H01R 13/73* (2013.01)

(58) Field of Classification Search

CPC ..... H01R 13/6592; H01R 13/5221; H01R 13/73; H01R 9/0518

USPC ..... 439/271

See application file for complete search history.

(56) References Cited

U.S. PATENT DOCUMENTS

| | | | | |
|---|---|---|---|---|
| 4,236,779 A | | 12/1980 | Tang | |
| 4,433,206 A | | 2/1984 | Lewis | |
| 4,531,805 A | | 7/1985 | Werth | |
| 4,684,192 A | | 8/1987 | Long | |
| 4,886,463 A | | 12/1989 | Scott | |
| 4,975,085 A | * | 12/1990 | Cartesse | H01R 13/6582 439/607.17 |

(Continued)

OTHER PUBLICATIONS

Azad, Vikas; U.S. Appl. No. 16/504,288, filed Jul. 7, 2019.

(Continued)

*Primary Examiner* — Harshad C Patel

(74) *Attorney, Agent, or Firm* — Kratz, Quintos & Hanson, LLP

(57) ABSTRACT

A method for reducing the effect of electromagnetic interference (EMI) to provide EMI protection to a connector assembly having at least one electrically conductive seal, a female connector assembly, and a male connector assembly. The method for reducing the effect of the EMI in the connector assembly includes the steps of: conducting the EMI, generated by at least a wire housed within the connector assembly (or other source), to a corresponding wire shielding that respectively surrounds the wire and to a corresponding crimped ferrule that surrounds the wire shielding; conducting the EMI through the female connector assembly and through the male connector assembly; and ultimately conducting the EMI to a housing of a device onto which the conductor assembly is connected or mounted.

20 Claims, 5 Drawing Sheets

(56) References Cited

U.S. PATENT DOCUMENTS

| | | | | |
|---|---|---|---|---|
| 5,326,947 | A | 7/1994 | Edds | |
| 5,531,614 | A | 7/1996 | Gallusser | |
| 6,083,014 | A | 7/2000 | Bogdan | |
| 6,554,623 | B2 * | 4/2003 | Yoshioka | H01R 13/6592 439/98 |
| 6,595,801 | B1 | 7/2003 | Leonard | |
| 6,815,610 | B2 | 11/2004 | Kuboshima | |
| 6,921,292 | B2 | 7/2005 | Miyazaki | |
| 7,104,822 | B2 | 9/2006 | Jazowski | |
| 7,165,995 | B2 | 1/2007 | Fukushima | |
| 7,182,612 | B1 * | 2/2007 | Immethun | H01R 13/6582 439/108 |
| 7,613,003 | B2 | 11/2009 | Pavlovic | |
| 7,614,910 | B2 | 11/2009 | Croteau | |
| 7,632,148 | B1 | 12/2009 | Kawamura | |
| 7,811,105 | B1 | 10/2010 | Tan Chin Yaw | |
| 8,262,413 | B2 * | 9/2012 | Fujiwara | H01R 13/6596 439/607.28 |
| 8,747,157 | B2 | 6/2014 | Tashiro | |
| 8,986,045 | B2 | 3/2015 | Okamoto | |
| 8,992,249 | B2 | 3/2015 | Kobayashi | |
| 9,040,846 | B2 | 5/2015 | Suzuki | |
| 9,252,509 | B2 * | 2/2016 | Kato | H01R 9/0518 |
| 9,337,577 | B1 | 5/2016 | Hitchcock | |
| 9,431,727 | B2 | 8/2016 | Kato | |
| 9,431,771 | B1 | 8/2016 | Sundarakrishnamachari et al. | |
| 9,496,656 | B2 | 11/2016 | Hsu | |
| 9,640,965 | B1 | 5/2017 | Long | |
| 9,716,374 | B2 | 7/2017 | Rohr | |
| 9,948,038 | B2 * | 4/2018 | Katou | H01R 13/5202 |
| 2002/0031949 | A1 * | 3/2002 | Miyazaki | H01R 13/5202 439/625 |
| 2002/0042228 | A1 | 4/2002 | Yoshioka | |
| 2002/0048994 | A1 | 4/2002 | Oota | |
| 2002/0098737 | A1 * | 7/2002 | Koide | H01R 13/748 439/607.01 |
| 2003/0008555 | A1 | 1/2003 | Obata | |
| 2004/0057187 | A1 | 3/2004 | Kuboshima | |
| 2004/0106325 | A1 | 6/2004 | Miyazaki | |
| 2004/0235351 | A1 | 11/2004 | Aisenbrey | |
| 2005/0215122 | A1 | 9/2005 | Nishida | |
| 2007/0149008 | A1 | 6/2007 | Pabst | |
| 2007/0270037 | A1 | 11/2007 | Deterre | |
| 2009/0124121 | A1 * | 5/2009 | Matsuoka | H01R 4/183 439/550 |
| 2009/0149048 | A1 | 6/2009 | Pavlovic | |
| 2009/0181571 | A1 | 7/2009 | Willing | |
| 2010/0261364 | A1 | 10/2010 | Matsuoka | |
| 2010/0279555 | A1 | 11/2010 | Azad | |
| 2012/0021632 | A1 | 1/2012 | Matsumoto | |
| 2012/0155988 | A1 | 6/2012 | Schumacher | |
| 2012/0252272 | A1 | 10/2012 | Omae | |
| 2013/0017719 | A1 | 1/2013 | Tanaka | |
| 2013/0078872 | A1 | 3/2013 | Tashiro | |
| 2014/0011401 | A1 | 1/2014 | Endo | |
| 2014/0038459 | A1 | 2/2014 | Kobayashi | |
| 2014/0127063 | A1 | 5/2014 | Itsuki | |
| 2014/0287631 | A1 | 9/2014 | Tashiro | |
| 2014/0370753 | A1 | 12/2014 | Kobayashi | |
| 2015/0050826 | A1 | 2/2015 | Tashiro | |
| 2015/0079859 | A1 | 3/2015 | Glick | |
| 2015/0087190 | A1 | 3/2015 | Schwan | |
| 2015/0270650 | A1 | 9/2015 | Bower | |
| 2015/0280381 | A1 | 10/2015 | Rangi | |
| 2016/0134049 | A1 | 5/2016 | Kataoka | |
| 2016/0172784 | A1 | 6/2016 | Kataoka | |
| 2016/0181736 | A1 | 6/2016 | Hsu | |
| 2016/0233625 | A1 | 8/2016 | Kato | |
| 2016/0329651 | A1 | 11/2016 | Yamaguchi | |
| 2016/0329661 | A1 | 11/2016 | Fischer | |
| 2017/0303446 | A1 | 10/2017 | Johansson | |
| 2017/0338600 | A1 | 11/2017 | Tanaka | |
| 2018/0034200 | A1 | 2/2018 | Rhein | |

OTHER PUBLICATIONS

Demaratos, David; U.S. Appl. No. 16/536,123, filed Aug. 8, 2019.
Azad, Vikas; U.S. Appl. No. 16/504,287, filed Jul. 7, 2019.
Demaratos, David; U.S. Appl. No. 16/583,915, filed Sep. 26, 2019.
Azad, Vikas; U.S. Appl. No. 16/370,069, filed Mar. 29, 2019.
Azad, Vikas; U.S. Appl. No. 16/369,943, filed Mar. 29, 2019.
Written Opinion of the International Searching Authority for International Application No. PCT/US2019/062861 dated Jan. 14, 2020 (8 sheets).
International Search Report for International Application No. PCT/US2019/062861 dated Jan. 14, 2020 (3 sheets).
International Search Report for International Application No. PCT/US19/42437 dated Oct. 21, 2019 (3 sheets).
Written Opinion of the International Searching Authority for International Application No. PCT/US19/42437 dated Oct. 21, 2019 (6 sheets).
International Search Report for International Application No. PCT/US19/63068 dated Feb. 11, 2020 (4 sheets).
Written Opinion of the International Searching Authority for International Application No. PCT/US19/63068 dated Feb. 11, 2020 (9 sheets).
International Search Report for International Application No. PCT/US19/45971 dated Feb. 6, 2020 (3 sheets).
Written Opinion of the International Searching Authority for International Application No. PCT/US19/45971 dated Feb. 6, 2020 (6 sheets).
Office Action of U.S. Appl. No. 16/369,943 dated Jan. 22, 2020.
Office Action of U.S. Appl. No. 16/536,123 dated Mar. 10, 2020.
Office Action of U.S. Appl. No. 16/370,069 dated Dec. 3, 2019.
Office Action of U.S. Appl. No. 16/370,069 dated Apr. 4, 2020.
Written Opinion of the International Searching Authority for International Application No. PCT/US2020/015929 dated Apr. 20, 2020 (6 sheets).
International Search Report for International Application No. PCT/US2020/015929 dated Apr. 20, 2020 (2 sheets).
International Preliminary Report on Patentability for International Application No. PCT/US2019/062861 dated Apr. 21, 2020 (12 sheets).

* cited by examiner

METHOD FOR ELECTROMAGNETIC INTERFERENCE (EMI) PROTECTION FOR A CONNECTOR ASSEMBLY USING A CONDUCTIVE SEAL

CROSS-REFERENCE TO RELATED APPLICATION

This patent application claims priority to U.S. Provisional Patent Application No. 62/811,873 filed Feb. 28, 2019, which is hereby incorporated herein by reference in its entirety.

BACKGROUND OF THE INVENTION

Electromagnetic interference (EMI) affects an electrical circuit due to a disturbance, from a source, by electromagnetic induction, electrostatic coupling or conduction. EMI may degrade the performance of a circuit or may even stop it from functioning. In the case where the circuit includes a data path, EMI may affect the effectiveness of the data path due to an increase in error rate to the total loss of the data. A source that may generate changing electrical currents and voltage that may cause EMI may include, for example, automotive injection systems, mobile phone cellular network, or the like. It is thus essential to manage the generation of EMI to avoid the detrimental effects caused by it; and to consequently maximize the effectiveness of an electrical circuit that may otherwise be vulnerable to the detrimental effects of EMI.

Ways to avoid or reduce the detrimental effects of EMI include conduction, shielding, or the like. EMI protection by conduction is achieved by the conduction of EMI between conductive elements or conductors that are in physical contact, while EMI protection by shielding is achieved by shielding radiated EMI by induction (i.e., the absence of physical contacts of conductors). In a connector assembly, conducted EMI is directed through a path of adjoining conductive elements or conductors and towards a device onto which the connector assembly is mounted.

SUMMARY OF THE INVENTION

The invention is directed to a method for reducing the effect of electromagnetic interference (EMI) to provide EMI protection to a connector assembly having a conductive seal, a female connector assembly, and a male connector assembly. The method of this invention for reducing the effect of the EMI in the connector assembly includes the steps of: conducting the EMI, generated by at least a wire housed within the connector assembly, to a corresponding wire shielding that respectively surrounds the wire and to a corresponding crimped ferrule that surrounds the wire shielding; conducting the EMI to a corresponding silicone back seal that respectively contacts the crimped ferrule, the silicone back seal being housed within and contacting at least a portion of a female housing connector assembly; conducting the EMI to the female connector assembly, the female connector assembly having a portion thereof being in contact with another silicone seal, the another silicone seal being located between and in contact with the portion of the female connector assembly and a portion of the male connector assembly. The method of this invention for reducing the effect of the EMI in the connector assembly further includes the steps of: conducting the EMI to the portion of the male connector assembly that surrounds and contacts the another silicone seal, the EMI being further conducted to the male connector assembly and towards a flange member of the male connector assembly, the flange accommodating at least a limiter that in turn accommodates therein a respective bolt that connects or mounts the connector assembly to a device. The method of this invention for reducing the effect of the EMI in the connector assembly additionally includes the steps of: conducting the EMI from the flange member of the male connector assembly to the limiter, which surrounds and contacts a corresponding bolt, and to the corresponding bolt; and subsequently, conducting the EMI through the bolt and ultimately to the device.

DETAILED DESCRIPTION OF THE PREFERRED EMBODIMENTS

Figure 1A:
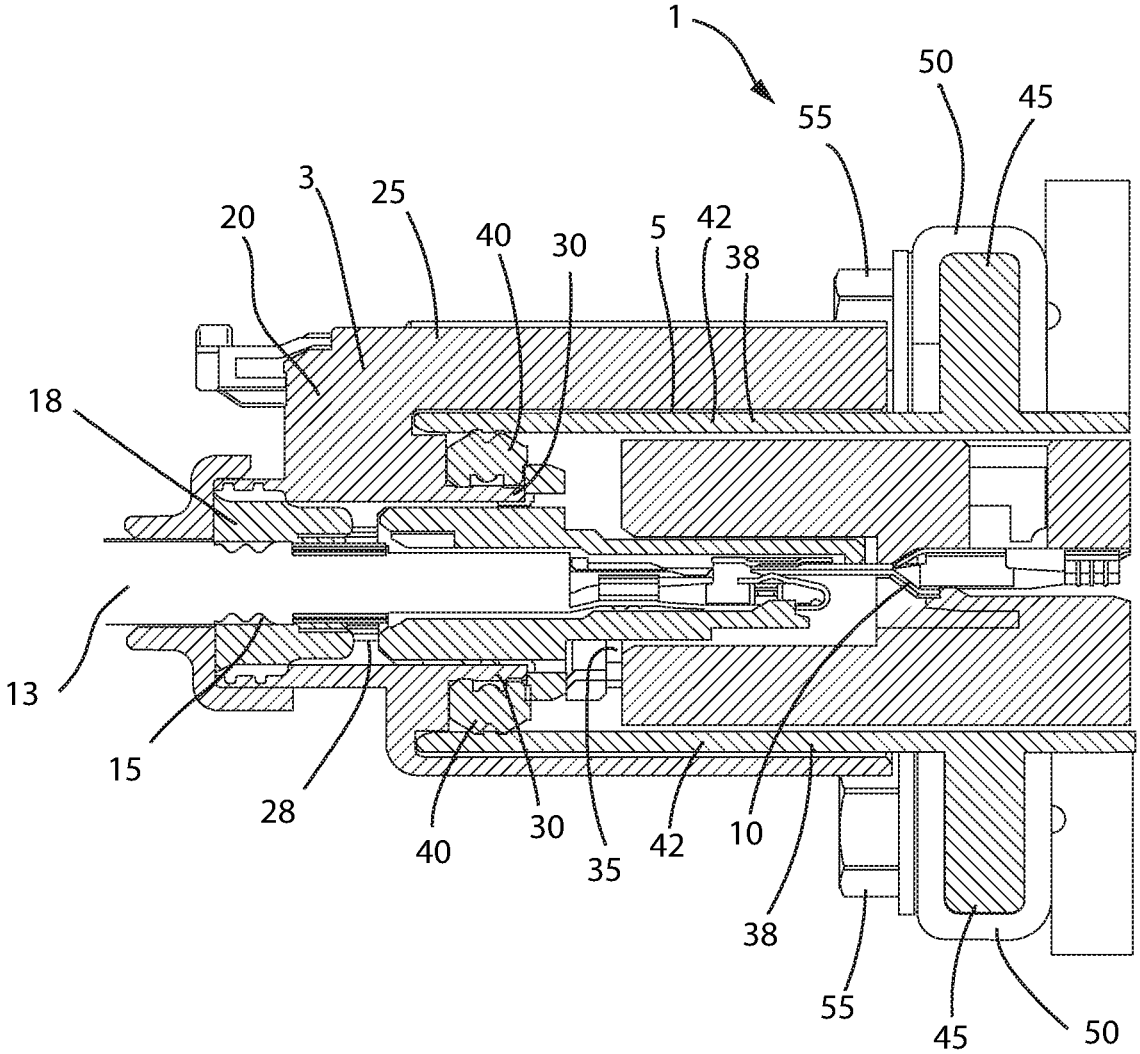
FIG. 1A is a cross-sectional view of a connector assembly showing various elements that make up a female connector assembly and a male connector assembly of the connector assembly.
Figure 1B:
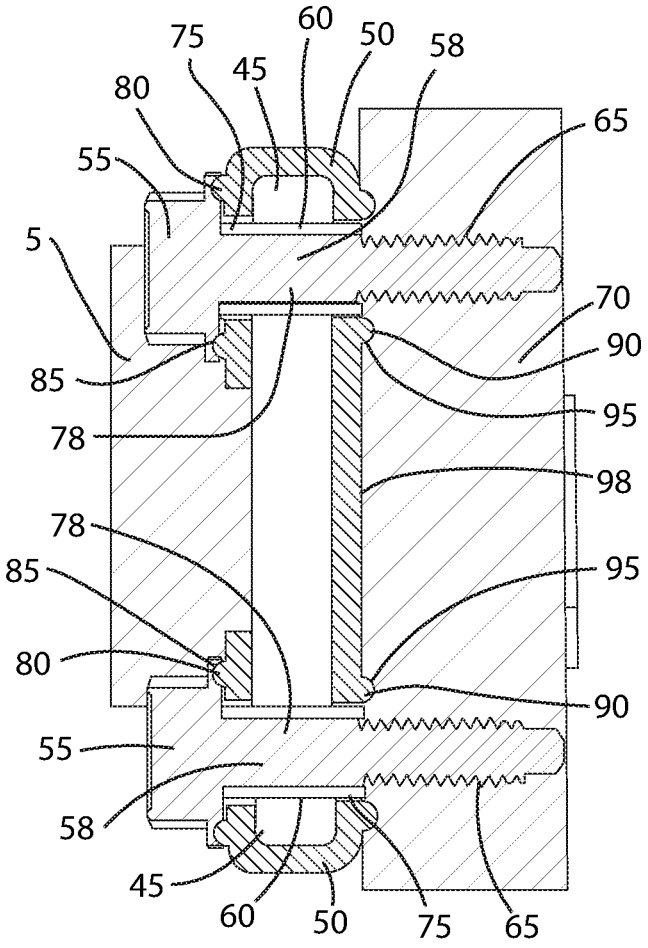
FIG. 1B is a cross-sectional view, which is a continuation of the view shown in FIG. 1A to complete the connector assembly, showing in more detail a device onto which the connector assembly is connected or mounted.

The connector assembly, generally referred to as reference number 1 in FIG. 1A and FIG. 1B, includes a female connector assembly 3 and a male connector assembly 5, the female connector assembly 3 and the male connector assembly 5 being coupled together, and FIG. 1B being a continuation of FIG. 1A to complete the connector assembly 1. The connector assembly 1 is preferably a high voltage connector assembly for housing therein high voltage wires 10 with respective wire shieldings 13. Surrounding each of the wire shieldings 13 is a corresponding crimped ferrule 15; and surrounding the crimpled ferrule 15 and the corresponding wire shielding 13 is a corresponding electrically conductive silicone back seal 18 inserted inside a back portion 20 of a female outer housing 25 of the female connector assembly 3.

The wire shielding 13 is made of metal, a conductive material, or the like. The crimped ferrule 15 is made of metal (e.g., copper, stainless steel, or the like). The electrically conductive silicone back seal 18 is made of an electrically conductive metal-infused silicone or the like. The female outer housing 25 is made of a metal-infused conductive plastic, resin, nylon, or the like. The female outer housing 25 may also be made of a stainless steel fiber-filled plastic, resin, nylon or the like.

The back portion 20 of the female outer housing 25 includes a back opening 28 for containing therein at least one of the high voltage wires 10 each surrounded by the corresponding wire shielding 13, which in turn is surrounded by the corresponding crimped ferrule 15 protected or sealed therearound by the corresponding electrically conductive silicone back seal 18.

Extending along a portion of the opening 28 is an extending member 30 extending from the back portion 20 of the female outer housing 25 of the female connector assembly 3 towards an opening 35 of a male outer housing 38 of the male connector assembly 5. A portion 42 of the male outer housing 38 surrounds an electrically conductive silicone ring seal 40 positioned between the extending member 30 of the female outer housing 25 and the male outer housing 38. The electrically conductive silicone ring seal 40 provides a seal between the extending member 30 of the female outer housing 25 and the male outer housing 38. The male outer housing 38 has, at end thereof away from the female connector assembly 3, a surrounding flange 45 (see also FIG. 1B, a continued illustration of the male connector assembly 5) extending therefrom.

The electrically conductive silicone ring seal 40 is made of a metal-infused silicone. The male outer housing 38 is made of a metal-infused conductive plastic, resin, nylon, or the like. The male outer housing 38 may also be made of a stainless steel fiber-filled plastic, resin, nylon, or the like.

Illustrated in either FIG. 1A or FIG. 1*b* is a non-conductive over-molded silicone seal 50, which surrounds exposed sides of the flange 45 (preferably the exposed sides in their entireties) of the male connector assembly 5. Although FIG. 1A shows the bolt heads 55 of the bolts 58 (made of stainless steel or the like), FIG. 1B more particularly illustrates the bolts 58 passing through apertures 60 that respectively pass through the flange 45 and the surrounding over-molded silicone seal 50. The bolts 58 have respective threads 65 for allowing the threaded bolts 58 to fasten the flange 45, surrounded by the over-molded silicone seal 50, to the device 70; and ultimately, the connector assembly 1 becomes mounted to the device 70.

Further illustrated in FIG. 1B are conductive compression limiters or rings 75 (made of aluminum or the like) respectively fitted inside the apertures 60, which in turn respectively accommodate therein the bodies 78 of the bolts 58, such that each conductive compression limiter or ring 75 rests between a corresponding one of the bolt body 78 and a corresponding side of the flange 45.

As further illustrated in FIG. 1B, the over-molded silicone seal 50 has a first set of pads 80, the pads 80 respectively resting inside indentations 85 beneath each head 55 of the corresponding bolt 58. The over-molded silicone seal 50 further has a second set of pads 90, the pads 90 respectively resting inside corresponding indentations 95 at an adjoining side 98 of the device 70.

The method for directing a conductive EMI through a path of conductive elements inside the connector assembly 1 is hereinafter described. The conductive EMI path is labeled in FIGS. 2A and 2B as a line arrow that extends beginning from a wire shielding 13 through the various conductive elements inside the connector assembly 1 and ultimately ending at the device 70.

Figure 2A:
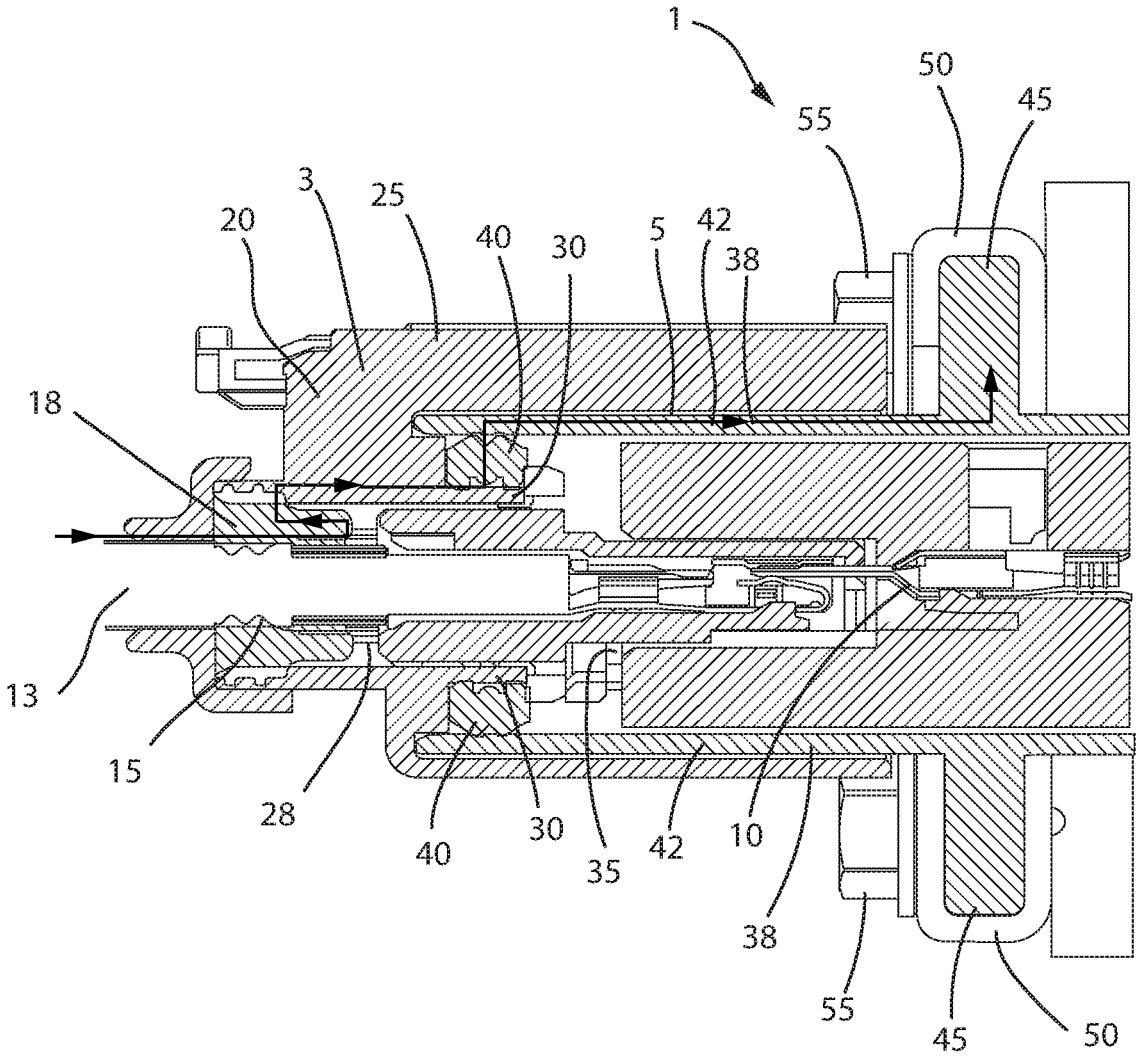
FIG. 2A is the cross-sectional view of the connector assembly, as in FIG. 1A, further showing a path through which EMI is conducted from a wire shielding through various conductive elements inside the connector assembly and towards a housing of an associated device onto which the connector assembly is connected or mounted.

As illustrated in FIG. 2A, the EMI generated by, e.g., the conducting high voltage wires 10 (or other source) is conducted to the corresponding wire shielding 13. The crimped ferrules 15 are in physical contact with and surrounding the corresponding wire shieldings 13; and thus, the EMI generated by, e.g., the wires 10 (or other source) is conducted to the corresponding wire shielding 13 and through the crimped ferrules 15. The crimped ferrules 15 are metallic and conductive, and preferably made of copper, stainless steel, or the like. The conducted EMI travels from the crimped ferrules 15 to the corresponding silicone back seals 18, each of the silicone back seals 18 being a metal-infused silicone back seal 18. From the silicone back seals 18, the conducted EMI further travels to the back portion 20 of the female outer housing 25. The conducted EMI is further conducted to the female outer housing 25 and to the electrically conducting silicone ring seals 40 that surround the extending member 30 that extends from the back portions 20 of the female outer housing 25, the silicone ring seal 40 being a metal-infused silicone ring seal 40. The conducted EMI then travels towards the portion 42 of the male outer housing 38 that surrounds the metal-infused silicone ring seals 40, and further travels through the male outer housing 38 towards the conductive compression limiters or rings 75 that respectively surround the corresponding bodies 78 of the bolts 58. The conducted EMI thus travels to the bolts 58, and is discharged to the device 70 (e.g., a compressor housing or the like), which is metallic.

Figure 2B:
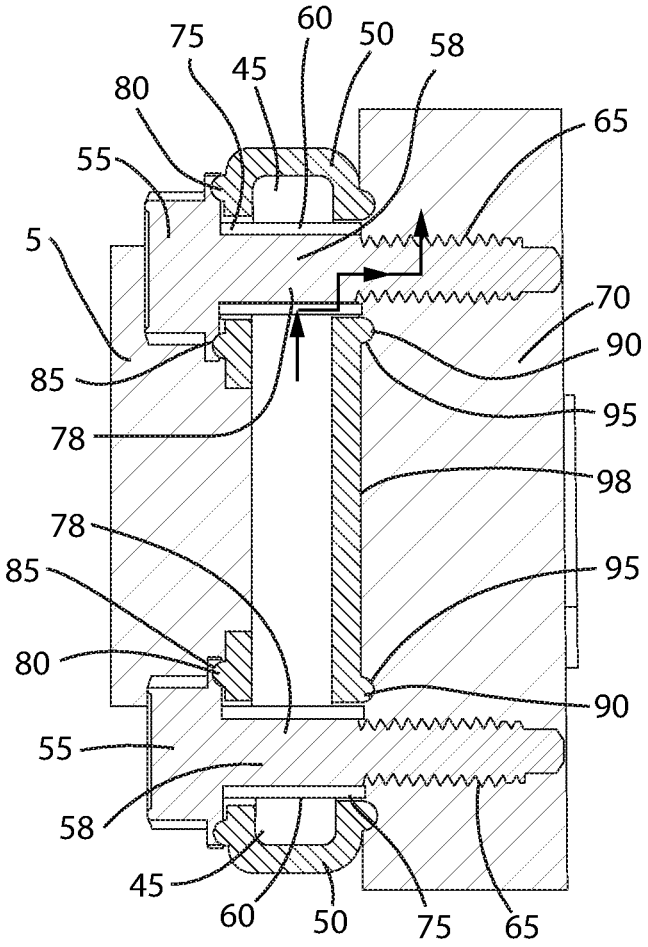
FIG. 2B is the cross-sectional view of the continuation of the view shown in FIG. 1B to complete the connector assembly, as in FIG. 1B, further showing in more detail the path through which the EMI is conducted from the connector assembly to the device onto which the connector assembly is connected or mounted.
Figure 3:
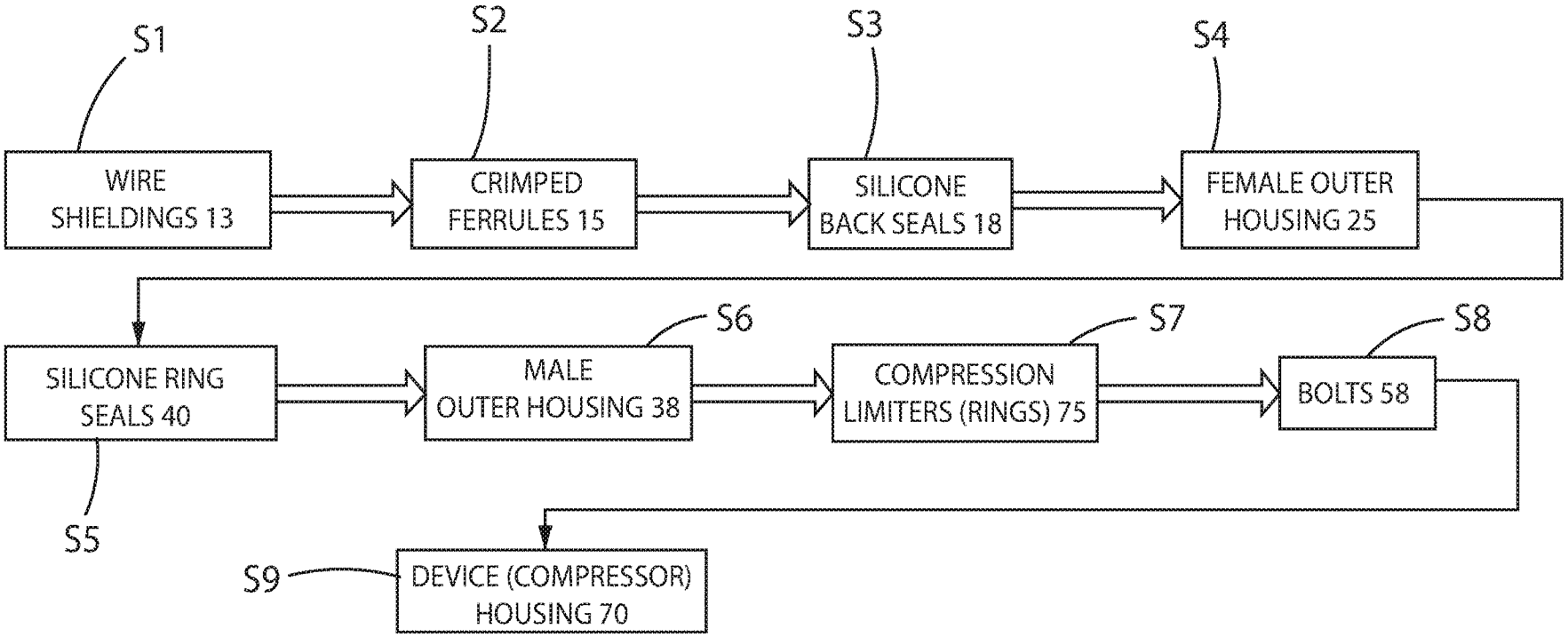
FIG. 3 is a flowchart of the path through which the EMI is conducted from the wire shielding through various conductive elements inside the connector assembly towards a housing of the associated device onto which the conductor assembly is connected or mounted.

FIG. 3 illustrates a flowchart of the conducted EMI flow path, the EMI flow path having just described in reference to FIGS. 2A and 2B. As shown in FIG. 3, in Step S1, the EMI is generated by the high voltage wires 10 and conducted to the corresponding wire shielding 13. The crimped ferrules 15 are in physical contact with and surround the corresponding wire shieldings 13; and thus, in Step S2, the EMI generated from the wires 10 is conducted to the corresponding wire shielding 13 and through the crimped ferrules 15. In Step S3, the conducted EMI travels from the crimped ferrules 15 to the corresponding silicone back seals 18. From the silicone back seals 18, the conducted EMI in Step S4 further travels to the back portion 20 of the female outer housing 25.

Further shown in FIG. 3, the conducted EMI is further conducted to the female outer housing 25 and, in Step S5, to the electrically conducting silicone ring seals 40 that surround the extending member 30 that extends from the back portions 20 of the female outer housing 25. In Step S6, the conducted EMI then travels towards the portion 42 of the male outer housing 38 that surrounds the metal-infused silicone ring seals 40, and further travels through the male outer housing 38 towards the conductive compression limiters or rings 75 (in Step S7) that respectively surround the corresponding bodies 78 of the bolts 58. The conducted EMI thus travels to the bolts 58 (in Step S8), and is discharged to the device 70 (in Step S9).

The present invention is not limited to the above-described embodiments; and various modifications in design, structural arrangement or the like may be used without departing from the scope or equivalents of the present invention.

I claim:

1. A method for reducing the effect of electromagnetic interference (EMI) to provide EMI protection to a connector assembly having at least one electrically conductive seal, a female connector assembly, and a male connector assembly, said method comprising the steps of:

conducting said EMI, generated by at least a wire housed within said connector assembly, to a corresponding wire shielding that respectively surrounds said wire and to a corresponding crimped ferrule that surrounds said wire shielding;

conducting said EMI to a corresponding electrically conductive silicone back seal that respectively contacts said crimped ferrule, said electrically conductive silicone back seal being housed within and contacting at least a portion of a female housing connector assembly;

conducting said EMI to said female connector assembly, said female connector assembly having a portion thereof being in contact with another electrically conductive silicone seal, said another electrically conductive silicone seal being located between and in contact with said portion of said female connector assembly and a portion of said male connector assembly;

conducting said EMI to said portion of said male connector assembly that surrounds and contacts said another electrically conductive silicone seal, said EMI being further conducted to said male connector assembly and towards a flange member of said male connector assembly, said flange accommodating at least a limiter that in turn accommodates therein a respective bolt that connects or mounts said connector assembly to a device;

conducting said EMI from said flange to said limiter and to a corresponding bolt that surrounds and contacts thereto; and subsequently, conducting said EMI through said bolt and to said device onto which said connector assembly is connected or mounted.

2. The method for reducing the effect of electromagnetic interference (EMI) to provide EMI protection to said connector assembly according to claim 1, wherein said terminal is a high voltage terminal.

3. The method for reducing the effect of electromagnetic interference (EMI) to provide EMI protection to said connector assembly according to claim 1, wherein said crimped ferrule is made of metal selected from the group consisting of copper and stainless steel.

4. The method for reducing the effect of electromagnetic interference (EMI) to provide EMI protection to said connector assembly according to claim 1, wherein said electrically conductive silicone back seal is a metal-infused electrically conductive silicone back seal.

5. The method for reducing the effect of electromagnetic interference (EMI) to provide EMI protection to said connector assembly according to claim 1, wherein said female outer housing is made of a metal-infused conductive plastic, resin, nylon or the like.

6. The method for reducing the effect of electromagnetic interference (EMI) to provide EMI protection to said connector assembly according to claim 4, wherein said another electrically conductive silicone seal, which is located between and in contact with said portion of said female connector assembly and said portion of said male connector assembly, is a metal-infused electrically conductive silicone seal.

7. The method for reducing the effect of electromagnetic interference (EMI) to provide EMI protection to said connector assembly according to claim 1, wherein said male outer housing is made of metal-infused conductive plastic, resin, nylon or the like.

8. The method for reducing the effect of electromagnetic interference (EMI) to provide EMI protection to said connector assembly according to claim 1, wherein said limiter is one of a compression limiter and a compression ring housed within said flange of said male outer housing, one of said compression limiter and said compression ring accommodates therein said respective bolt that connects or mounts said connector assembly to said device.

9. The method for reducing the effect of electromagnetic interference (EMI) to provide EMI protection to said connector assembly according to claim 1, wherein one of a compression limiter and a compression ring is made of metal selected from the group consisting of aluminum, and stainless steel.

10. The method for reducing the effect of electromagnetic interference (EMI) to provide EMI protection to said connector assembly according to claim 1, wherein said bolt is made of stainless steel.

11. The method for reducing the effect of electromagnetic interference (EMI) to provide EMI protection to said connector assembly according to claim 1, wherein said device is a compressor.

12. The method for reducing the effect of electromagnetic interference (EMI) to provide EMI protection to said connector assembly according to claim 11, wherein a housing of said compressor is made of metal.

13. The method for reducing the effect of electromagnetic interference (EMI) to provide EMI protection to said connector assembly according to claim 1, wherein at least one of said female outer housing and said male outer housing is made of a stainless steel fiber-filled plastic, resin, nylon, or the like.

14. A method for reducing the effect of electromagnetic interference (EMI) to provide EMI protection to a connector assembly having at least one electrically conductive seal, a female connector assembly, and a male connector assembly, said method comprising the steps of:

conducting said EMI, generated by at least a wire housed within said connector assembly, to a corresponding wire shielding that respectively surrounds said wire and to a corresponding crimped ferrule that surrounds said wire shielding;

conducting said EMI through said female connector assembly and through said male connector assembly; and ultimately conducting said EMI to a housing of a device onto which said conductor assembly is connected or mounted, wherein one of:

(a) said step of conducting said EMI through said female connector assembly includes a step of conducting said EMI through at least a silicone back seal, and (b) said step of conducting said EMI through said male connector assembly includes a step of conducting said EMI through at least a silicone ring seal.

15. The method for reducing the effect of electromagnetic interference (EMI) to provide EMI protection to a connector assembly according to claim 14, wherein said female connector assembly includes a female housing and said male connector assembly includes a male housing, wherein each of said female housing and said male housing is made of a metal-infused material, said material being selected from the group consisting of plastic, resin, and nylon.

16. The method for reducing the effect of electromagnetic interference (EMI) to provide EMI protection to a connector assembly according to claim 14, wherein said female connector assembly includes a female housing and said male connector assembly includes a male connector housing, wherein each of said female housing and said male housing is made of a stainless steel-filled material, said material being selected from the group consisting of plastic, resin, and nylon.

17. The method for reducing the effect of electromagnetic interference (EMI) to provide EMI protection to a connector assembly according to claim 14, wherein said step of conducting said EMI through said female connector assembly includes a step of conducting said EMI through an electrically conductive silicone seal, said electrically conductive silicone seal is a metal-infused electrically conductive silicone seal.

18. The method for reducing the effect of electromagnetic interference (EMI) to provide EMI protection to a connector assembly according to claim 17, wherein said step of conducting said EMI through said male connector assembly includes a step of conducting said EMI through an electrically conductive silicone seal, said electrically conductive silicone seal is a metal-infused electrically conductive silicone seal.

19. The method for reducing the effect of electromagnetic interference (EMI) to provide EMI protection to a connector assembly according to claim 14, wherein said step of conducting said EMI through said female connector assembly includes a step of conducting said EMI through at least said silicone back seal, and wherein said step of conducting said EMI through said male connector assembly includes a step of conducting said EMI through at least said silicone ring seal.

20. The method for reducing the effect of electromagnetic interference (EMI) to provide EMI protection to a connector assembly according to claim 14, wherein said step of conducting said EMI through said female connector assembly includes a step of conducting said EMI through at least an electrically conductive silicone back seal, said electrically conductive silicone back seal is a metal-infused electrically conductive silicone back seal, and wherein said step of conducting said EMI through said male connector assembly includes a step of conducting said EMI through at least an electrically conductive silicone ring seal, said electrically conductive silicone ring seal is a metal-infused electrically conductive silicone ring seal.

* * * * *